US011913705B2

(12) United States Patent
Fang et al.

(10) Patent No.: US 11,913,705 B2
(45) Date of Patent: Feb. 27, 2024

(54) REFRIGERATOR AND CONTROL METHOD AND CONTROL DEVICE THEREOF

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventors: Ruiming Fang, Anhui (CN); Yu Li, Anhui (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 189 days.

(21) Appl. No.: 17/420,663

(22) PCT Filed: Jan. 3, 2019

(86) PCT No.: PCT/CN2019/070281

§ 371 (c)(1),
(2) Date: Jul. 2, 2021

(87) PCT Pub. No.: WO2020/140238

PCT Pub. Date: Jul. 9, 2020

(65) Prior Publication Data

US 2022/0099354 A1 Mar. 31, 2022

(51) Int. Cl.
*F25D 21/06* (2006.01)
*F25D 11/02* (2006.01)

(52) U.S. Cl.
CPC ..... *F25D 21/06* (2013.01); *F25D 11/022* (2013.01); *F25C 2400/10* (2013.01); *F25C 2600/04* (2013.01)

(58) Field of Classification Search
CPC ..... F25D 21/06; F25D 11/022; F25D 21/006; F25C 2400/10; F25C 2600/04;
(Continued)

(56) References Cited

U.S. PATENT DOCUMENTS 4,328,681 A * 5/1982 Sakamoto ..... F25C 1/147 62/157
4,344,295 A 8/1982 Limstromberg
(Continued)

FOREIGN PATENT DOCUMENTS

CN 1912511 A 2/2007
CN 100374799 C 3/2008
(Continued)

OTHER PUBLICATIONS

Canadian Office Action dated Oct. 18, 2022, for the corresponding Canadian Patent Application No. 3,126,296, 4 pages.

*Primary Examiner* — Nelson J Nieves
*Assistant Examiner* — Matthew John Moscola
(74) *Attorney, Agent, or Firm* — Seed IP Law Group LLP

(57) ABSTRACT

Disclosed by the present application are a refrigerator, and a method and a device for controlling the refrigerator. The method includes detecting and confirming that a refrigerator is in a first control cycle after defrosting; detecting and confirming that an ice making evaporator requests cooling, and controlling a control valve to be in communication with an ice making circuit. The method controls the refrigerant to preferentially enter the ice making circuit after the refrigerator defrosts, thereby effectively reducing the time that an ice making compartment is in a high-temperature state due to defrosting, and decreasing the risk that ice cubes might be adhered to each other due to ice cubes melting and then re-freezing. As a result, the long-term high-quality storage of ice cubes is achieved.

15 Claims, 4 Drawing Sheets

(58) Field of Classification Search
CPC .... F25B 2600/2519; F25B 49/02; F25B 5/02; F25B 2600/2511
See application file for complete search history.

(56) References Cited

U.S. PATENT DOCUMENTS

| | | | | |
|---|---|---|---|---|
| 7,681,406 | B2 | 3/2010 | Cushman et al. | |
| 8,484,987 | B2 | 7/2013 | Ducharme et al. | |
| 2008/0190125 | A1 | 8/2008 | Yoshioka et al. | |
| 2012/0023975 | A1* | 2/2012 | Yoon | F25D 11/022 62/81 |
| 2013/0025303 | A1 | 1/2013 | Yoon et al. | |
| 2017/0030627 | A1* | 2/2017 | Kim | F25B 47/022 |
| 2018/0283758 | A1 | 10/2018 | Ding et al. | |
| 2018/0328642 | A1* | 11/2018 | McCollough | F25C 1/12 |

FOREIGN PATENT DOCUMENTS

| | | | |
|---|---|---|---|
| CN | 102374722 | A | 3/2012 |
| CN | 102997609 | A | 3/2013 |
| CN | 103574959 | A | 2/2014 |
| CN | 106123478 | A | 11/2016 |
| CN | 108885050 | A | 11/2018 |
| EP | 2401564 | A2 | 1/2012 |
| JP | 4-9566 | A | 1/1992 |
| JP | 2002022336 | A | 1/2002 |
| JP | 3545617 | B2 | 7/2004 |
| JP | 2006-226615 | A | 8/2006 |
| JP | 2014-35128 | A | 2/2014 |
| WO | WO 2010099439 | A2 | 9/2010 |

* cited by examiner

REFRIGERATOR AND CONTROL METHOD AND CONTROL DEVICE THEREOF

BACKGROUND

Technical Field

The present disclosure relates to the field of a refrigerator technique, particularly relates to a control method for a refrigerator, a control apparatus of a refrigerator, a refrigerator and an electronic device.

Description of the Related Art

At present, for a refrigerator with an ice making function, a refrigerant is generally controlled to flow through a refrigerating circuit or a freezing circuit to refrigerate a freezing compartment or a refrigerating compartment, after a defrosting program is performed. The refrigerant is controlled to flow into an ice making circuit after refrigerating the freezing compartment or the refrigerating compartment.

However, during the defrosting period for a refrigerator, the temperature of the ice making compartment will rise. If after the defrosting, the refrigerant is flowed into a non-ice making circuit first, the ice making compartment will be in the temperature-rising state caused by the defrosting process for a longer duration; and thus there is an increasing risk that ice cubes may melt. Moreover, re-freezing of the melted ice cubes may cause the ice cubes to adhere together. The adhering of the ice cubes may become severe after several defrosting processes. As a result, ice maker cannot produce ice smoothly and thus fails to work normally. Further, when the ice making compartment is kept at a high-temperature state for a longer period of time, the long-term storage of the ice cubes is adversely affected.

BRIEF SUMMARY

The present disclosure aims to solve at least one of the technical problems in the related art to a certain degree. For this, the present disclosure provides in embodiments a control method for a refrigerator. The method can control a refrigerant to be flowed into an ice making circuit preferentially after defrosting for a refrigerator, thereby effectively decreasing the time of an ice making compartment being in a high-temperature state caused by the defrosting, and reducing risks where ice tubes melt and melted ice cubes are adhered together resulted from re-freezing of the melted ice cubes. As a result, a long-term and high-quality storage of the ice cubes can be achieved.

The present disclosure further provides in embodiments a control apparatus of a refrigerator.

The present disclosure further provides in embodiments a refrigerator.

The present disclosure further provides in embodiments an electronic device.

The present disclosure further provides in embodiments a non-temporary computer-readable storage medium.

In a first aspect, the present disclosure provides in embodiments a method for controlling a refrigerator, including: detecting and confirming that the refrigerator is in the first control period after defrosting; detecting and confirming that an ice making evaporator requests refrigeration; and controlling a control valve to connect to an ice making circuit.

According to embodiments in the present disclosure, when the refrigerator is in the first control period after defrosting, if the ice making evaporator requests refrigeration, the method for controlling a refrigerator controls the control valve to connect to the ice making circuit, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

In addition, the method for controlling a refrigerator according to the above embodiments of the present disclosure may further include the following additional technical features.

According to some embodiments of the present disclosure, after said detecting and confirming that the refrigerator is in the first control period after defrosting, the method further includes detecting and confirming that the ice making evaporator does not request refrigeration and a system evaporator requests refrigeration, and controlling the control valve to connect to a refrigerating circuit.

According to some embodiments of the present disclosure, the method for controlling a refrigerator as described above further includes detecting and confirming that the refrigerator is in a non-first control period after defrosting; detecting and confirming that the ice making evaporator requests refrigeration and the system evaporator requests refrigeration; controlling the control valve to connect to the refrigerating circuit, when the ice making circuit is connected to the refrigerating circuit in series and parallel; controlling the control valve to connect to the refrigerating circuit and the ice making circuit respectively, when the ice making circuit is connected to the refrigerating circuit in parallel only.

According to some embodiments of the present disclosure, after said detecting and confirming that the refrigerator is in a non-first control period after defrosting, the method further includes detecting and confirming that the ice making evaporator requests refrigeration and the system evaporator does not request refrigeration, and controlling the control valve to connect to the ice making circuit.

According to some embodiments of the present disclosure, after said detecting and confirming that the refrigerator is in a non-first control period after defrosting, the method further includes detecting and confirming that the ice making evaporator does not request refrigeration and the system evaporator requests refrigeration, and controlling the control valve to connect to the refrigerating circuit.

According to some embodiments of the present disclosure, after said detecting and confirming that the refrigerator is in a non-first control period after defrosting, the method further includes detecting and confirming that the ice making evaporator does not request refrigeration and the system evaporator does not request refrigeration, and controlling the control valve to remain at the current direction.

In a second aspect, the present disclosure provides in embodiments a control apparatus of a refrigerator, including: a first detecting module, configured to detect and confirm that the refrigerator is in the first control period after defrosting; and a first controlling module, configured to detect and confirm that an ice making evaporator requests refrigeration, and to control a control valve to connect to an ice making circuit.

According to the control apparatus of a refrigerator in embodiments of the present disclosure, the first detecting module detects and confirms that the refrigerator is in the first control period after defrosting, and the first controlling module detects and confirms that an ice making evaporator requests refrigeration, and controls a control valve to connect to an ice making circuit, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

In addition, the control apparatus of a refrigerator according to the above embodiments of the present disclosure may further include the following additional technical features.

According to some embodiments of the present disclosure, the first controlling module is further configured to: detect and confirm that the ice making evaporator does not request refrigeration and a system evaporator requests refrigeration, and control the control valve to connect to a refrigerating circuit; detect and confirm that the ice making evaporator does not request refrigeration and the system evaporator does not request refrigeration, and control the control valve to remain at the current direction.

According to some embodiments of the present disclosure, the above control apparatus further includes a second detecting module, configured to detect and confirm that the refrigerator is in a non-first control period after defrosting; and a second controlling module, configured to: detect and confirm that the ice making evaporator requests refrigeration and the system evaporator requests refrigeration; control the control valve to connect to the refrigerating circuit, when the ice making circuit is connected to the refrigerating circuit in series and parallel; control the control valve to connect to the refrigerating circuit and the ice making circuit respectively, when the ice making circuit is connected to the refrigerating circuit in parallel only; detect and confirm that the ice making evaporator requests refrigeration and the system evaporator does not request refrigeration, and control the control valve to connect to the ice making circuit; detect and confirm that the ice making evaporator does not request refrigeration and the system evaporator requests refrigeration, and control the control valve to connect to the refrigerating circuit; detect and confirm that the ice making evaporator does not request refrigeration and the system evaporator does not request refrigeration, and control the control valve to remain at the current direction.

In a third aspect, the present disclosure provides in embodiments a refrigerator, including a control apparatus as described in the second aspect of embodiments of the present disclosure.

According to embodiments of the present disclosure, the refrigerator can control the refrigerant using the above control apparatus so that the refrigerant can flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

In a fourth aspect, the present disclosure provides in embodiments an electronic device, including: a memory, a processor, and a computer program stored in the memory and executable by the processor, wherein the processor, when executing the program, achieves a control method for a refrigerator as described in the first aspect of embodiments of the present disclosure.

According to embodiments of the present disclosure, when the processor executes the computer program stored in the memory, and when a refrigerator is in the first control period after defrosting, the electronic device controls a control valve to connect to an ice making circuit, if an ice making evaporator requests refrigeration, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

In a fifth aspect, the present disclosure provides in embodiments a non-temporary computer-readable storage medium having stored therein a computer program that, when executed by a processor, achieves a control method for a refrigerator as described in the first aspect of embodiments of the present disclosure.

According to embodiments in the present disclosure, when the processor executes the computer program stored in the non-temporary computer-readable storage medium, and when a refrigerator is in the first control period after defrosting, the non-temporary computer-readable storage medium controls a control valve to connect to an ice making circuit, if an ice making evaporator requests refrigeration, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

BRIEF DESCRIPTION OF THE SEVERAL VIEWS OF THE DRAWINGS

The above and/or additional aspects and advantages of the present disclosure will become obvious and understandable with the following description for embodiments by combining the drawings.

DETAILED DESCRIPTION

Figure 1:
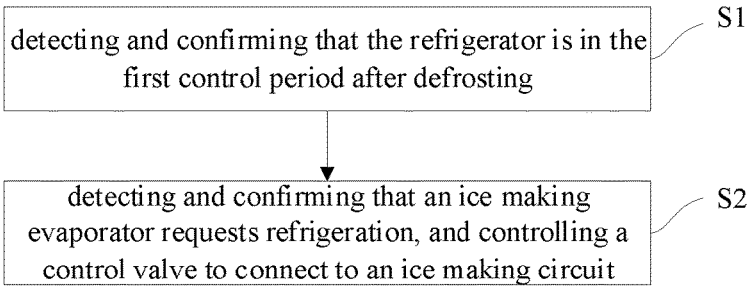
FIG. 1 is a flow chart showing a method for controlling a refrigerator according to some embodiments of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

The control method for a refrigerator, the control apparatus of a refrigerator, the refrigerator, the electronic device and the non-temporary computer readable storage medium according to embodiments of the present disclosure are described below with reference to the drawings.

FIG. 1 is a flow chart showing a method for controlling a refrigerator according to some embodiments of the present disclosure. As shown in FIG. 1, the method includes the following steps: S1 and S2.

At S1, a refrigerator being in a first control period after defrosting is detected and confirmed.

At S2, after detecting and confirming that an ice making evaporator requests refrigeration, a control valve is controlled to connect to an ice making circuit.

Figure 2:
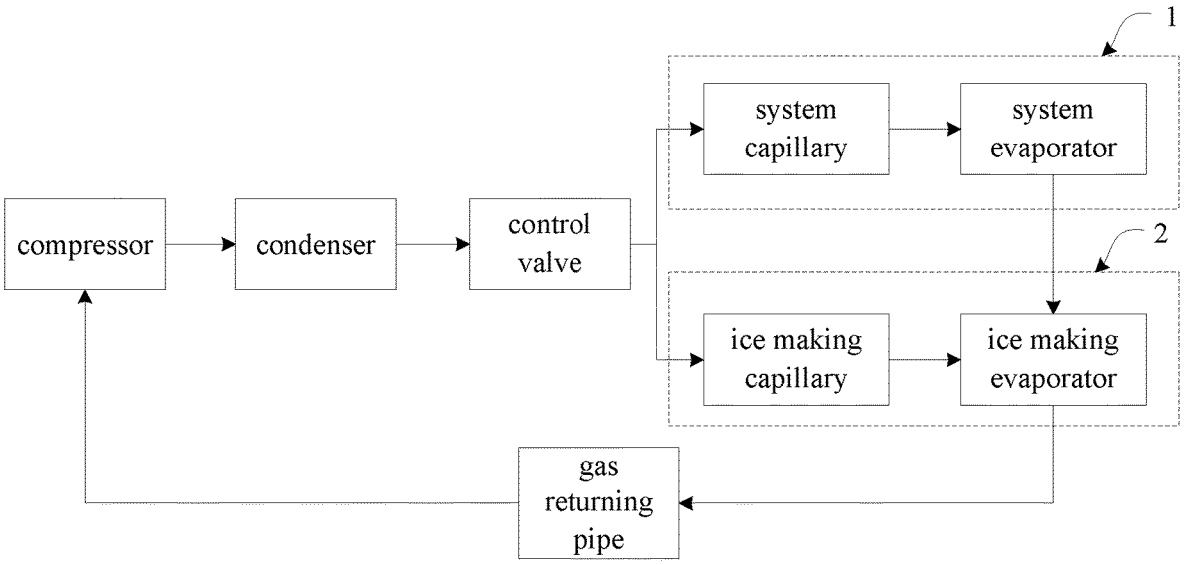
FIG. 2 is a block diagram showing a refrigerating system of a refrigerator according to some embodiments of the present disclosure.
Figure 3:
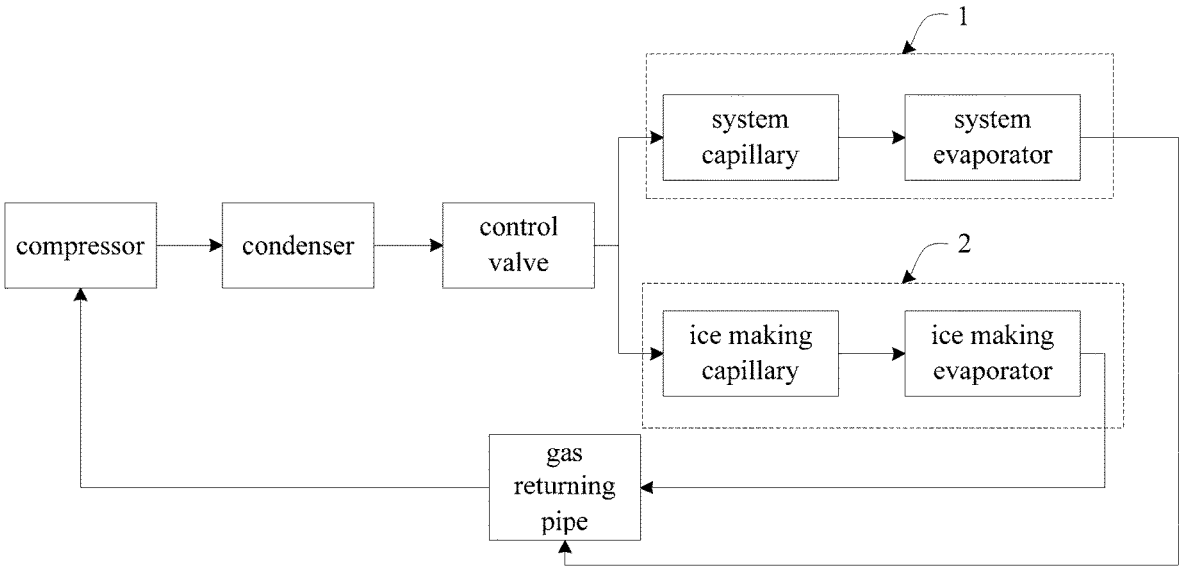
FIG. 3 is a block diagram showing a refrigerating system of a refrigerator according to some embodiments of the present disclosure.

Specifically, as shown in FIGS. 2 and 3, a refrigerator includes a refrigerating system, which includes a refrigerating circuit 1 and an ice making circuit 2. The ice making circuit 2 may be connected to the refrigerating circuit 1 in series and parallel (FIG. 2), or in parallel only (FIG. 3). The refrigerating system includes at least a compressor, a condenser, a control valve, a system capillary, an ice making capillary, a system evaporator, an ice making evaporator and a gas returning pipe. The refrigerating circuit 1 includes a system capillary and a system evaporator. The ice making circuit 2 includes an ice making capillary and an ice making evaporator.

When the refrigerator is in the first control period after defrosting, if the ice making evaporator requests refrigeration, no matter whether the refrigerating evaporator requests refrigeration or not, the control valve is connected to the ice making capillary, such that the control valve is connected to the ice making circuit, and thus ensuring the refrigerant to be flowed into the ice making circuit preferentially when the ice making evaporator requests refrigeration after defrosting, and ensuring the temperature of the ice making compartment return to a preset range rapidly, thereby effectively decreasing the time of the ice making compartment being in the high-temperature state caused by the defrosting, reducing the risk where ice tubes melt and the melted ice cubes are adhered together resulted from re-freezing of the melted ice cubes. As a result, a long-term and high-quality storage of the ice cubes can be achieved.

Figure 4:
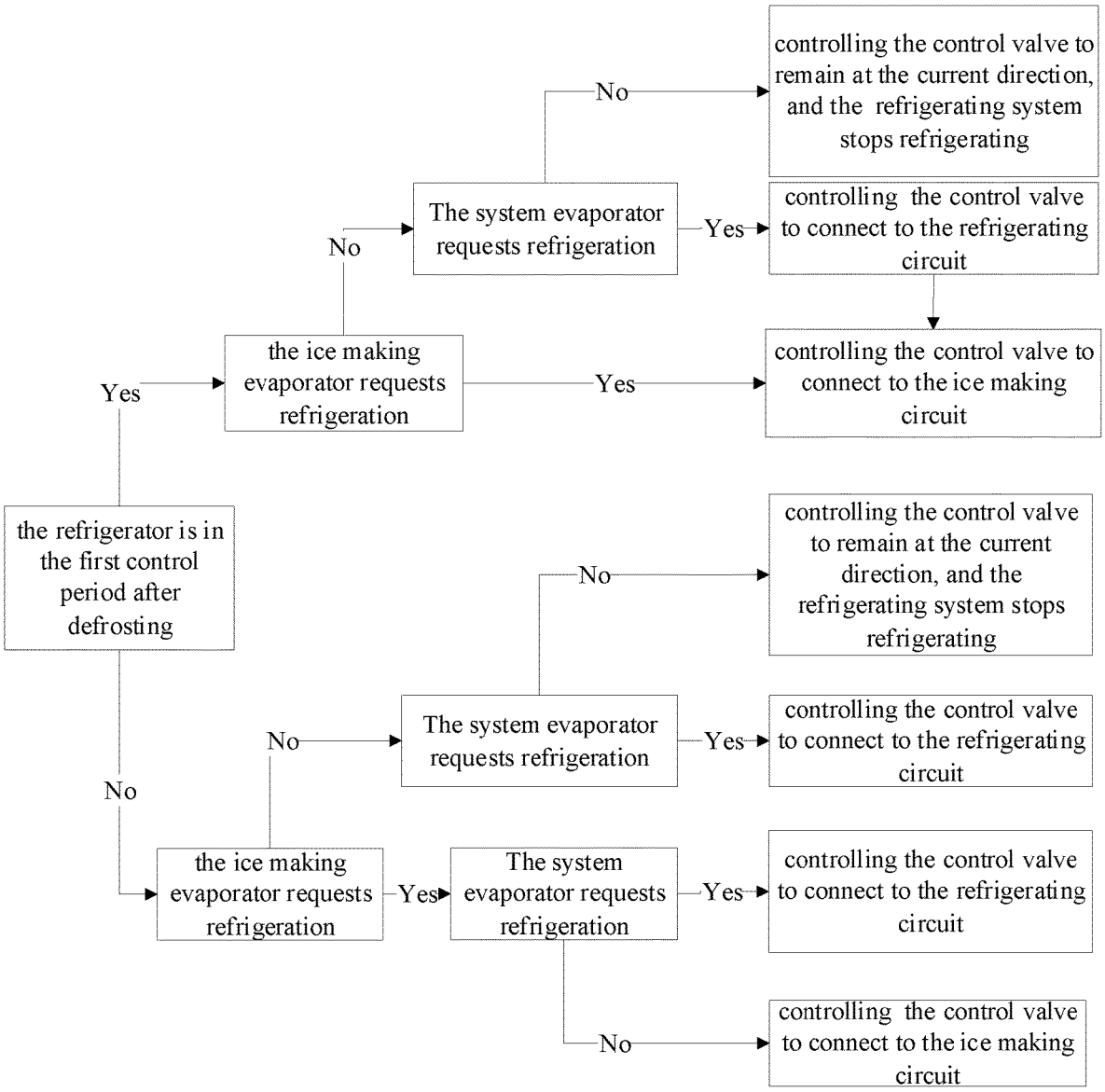
FIG. 4 is a flow chart showing a method for controlling a refrigerator when an ice making circuit is connected to a refrigerating circuit in series and parallel according to some embodiments of the present disclosure.
Figure 5:
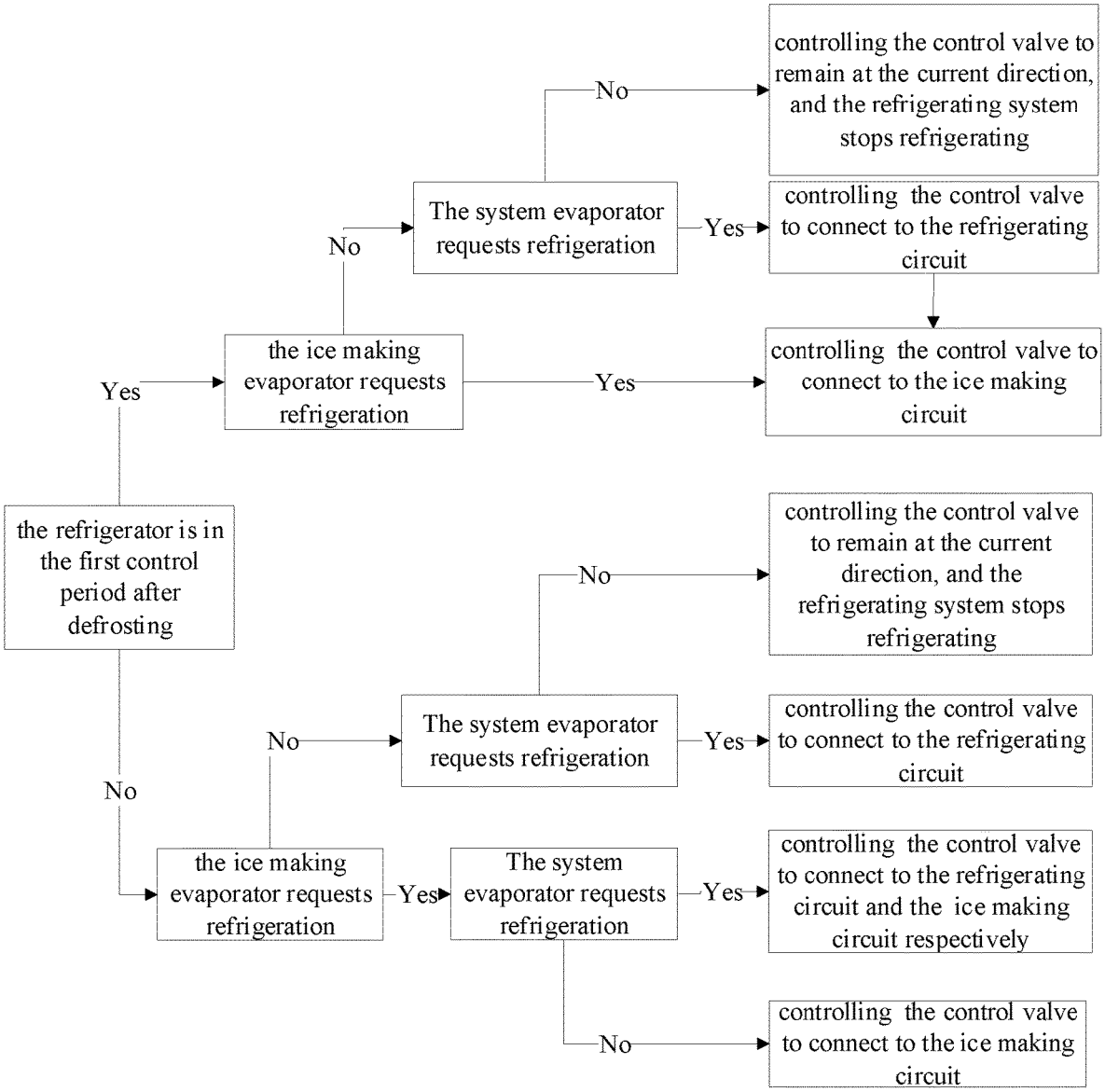
FIG. 5 is a flow chart showing a method for controlling a refrigerator when an ice making circuit is connected to a refrigerating circuit in parallel only according to some embodiments of the present disclosure.

FIG. 4 is a flow chart showing a method for controlling a refrigerator when an ice making circuit is connected to a refrigerating circuit in series and parallel according to some embodiments of the present disclosure. FIG. 5 is a flow chart showing a method for controlling a refrigerator when an ice making circuit is connected to a refrigerating circuit in parallel only according to some embodiments of the present disclosure. That is, FIG. 4 is a flow chart corresponding to the method for controlling the system shown in FIG. 2, and FIG. 5 is a flow chart corresponding to the method for controlling the system shown in FIG. 3. The method for controlling a refrigerator with different refrigerating systems is described below with reference to specific embodiments.

According to some embodiments of the present disclosure, after detecting and confirming that the refrigerator is in the first control period after defrosting, the above control method may further include detecting and confirming that the ice making evaporator does not request refrigeration and a system evaporator requests refrigeration, and controlling the control valve to connect to a refrigerating circuit; or detecting and confirming that the ice making evaporator does not request refrigeration and the system evaporator does not request refrigeration, and controlling the control valve to remain at the current direction.

Specifically, as shown in FIG. 4 and FIG. 5, when the refrigerator is running and the refrigerator is in the first control period after defrosting, if the ice making evaporator requests refrigeration, the control valve is controlled to switch to the ice making capillary, such that the control valve is connected to the ice making circuit; if the ice making evaporator does not request refrigeration and the system evaporator requests refrigeration, the control valve is controlled to switch to the system capillary, such that the control valve is connected to the refrigerating circuit, thus the system evaporator performs refrigeration and the ice making evaporator does not perform refrigeration; if the ice making evaporator does not request refrigeration and the system evaporator does not request refrigeration, a current direction of the control valve is kept unchanged, and the entire refrigerating system stops refrigerating.

According to some embodiments of the present disclosure, the above control method further includes detecting and confirming that the refrigerator is in a non-first control period after defrosting; detecting and confirming that the ice making evaporator requests refrigeration and the system evaporator requests refrigeration; controlling the control valve to connect to the refrigerating circuit, when the ice making circuit is connected to the refrigerating circuit in series and parallel; controlling the control valve to connect to the refrigerating circuit and the ice making circuit respectively, when the ice making circuit is connected to the refrigerating circuit in parallel only.

Specifically, as shown in FIG. 4, when the ice making circuit is connected to the refrigerating circuit in series and parallel and the refrigerator is in the non-first control period after defrosting, if the ice making evaporator requests refrigeration and the system evaporator requests refrigeration, the control valve is connected to the system capillary, such that the control valve is connected to the refrigerating circuit, thus the system evaporator and the ice making evaporator perform refrigeration at the same time.

As shown in FIG. 5, when the ice making circuit is connected to the refrigerating circuit in parallel only and the refrigerator is not in the first control period after defrosting, if the ice making evaporator requests refrigeration and the system evaporator requests refrigeration, the control valve is connected to the system capillary and the ice making capillary respectively, such that the control valve is connected to the refrigerating circuit and the ice making circuit respectively, thus the system evaporator and the ice making evaporator perform refrigeration at the same time.

According to some embodiments of the present disclosure, after detecting and confirming that the refrigerator is in a non-first control period after defrosting, the above control method may further include detecting and confirming that the ice making evaporator requests refrigeration and the system evaporator does not request refrigeration, and controlling the control valve to connect to the ice making circuit; detecting and confirming that the ice making evaporator does not request refrigeration and the system evaporator requests refrigeration, and controlling the control valve to connect to the refrigerating circuit; detecting and confirming that the ice making evaporator does not request refrigeration and the system evaporator does not request refrigeration, and controlling the control valve to remain at the current direction.

Specifically, as shown in FIG. 4 and FIG. 5, when the refrigerator is in the non-first control period after defrosting, if the ice making evaporator requests refrigeration and the system evaporator does not request refrigeration, the control valve is controlled to switch to the ice making capillary, such that the control valve is connected to the ice making circuit, and the ice making evaporator performs refrigeration alone; if the ice making evaporator does not request refrigeration and the system evaporator requests refrigeration, the control valve is controlled to switch to the system capillary, such that the control valve is connected to the refrigerating circuit, and the system evaporator performs refrigeration alone; if the ice making evaporator does not request refrigeration and the system evaporator does not request refrigeration, the control valve is controlled to remain at the current direction, and the entire refrigerating system stops refrigerating.

It would be understood that the difference between FIG. 4 and FIG. 5 is that, if the refrigerator is in the non-first control period after defrosting, and when the ice making evaporator requests refrigeration and the system evaporator requests refrigeration, for a series-parallel connection system, the control method shown in FIG. 4 includes the following operations: the control valve being connected to the system capillary, the control valve being connected to the refrigerating circuit, and the system evaporator and the ice making evaporator performing refrigeration at the same time; while for a parallel-only connection system, the control method shown in FIG. 5 includes the following operations: the control valve being connected to the refrigerating circuit and the ice making circuit respectively, and the system evaporator and the ice making evaporator performing refrigeration at the same time.

In summary, according to embodiments in the present disclosure, when the refrigerator is in the first control period after defrosting, if the ice making evaporator requests refrigeration, the control method for the refrigerator controls the control valve to connect to the ice making circuit, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and the melted ice cubes are adhered together resulted from re-freezing of the melted ice cubes. As a result, a long-term and high-quality storage of the ice cubes can be achieved.

Corresponding to the method for controlling a refrigerator as described above, the present disclosure further provides in embodiments a control apparatus of a refrigerator. Details that are not disclosed in the apparatus embodiments may refer to the above method embodiments, which are not repeated here in the apparatus embodiments.

Figure 6:
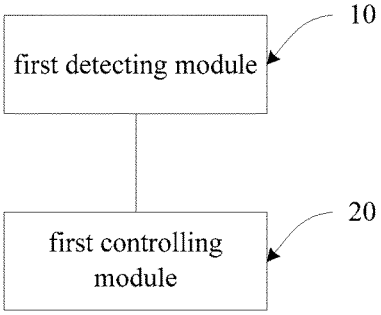
FIG. 6 is a block diagram showing a control apparatus of a refrigerator according to some embodiments of the present disclosure.

FIG. 6 is a block diagram showing a control apparatus of a refrigerator according to some embodiments of the present disclosure. As shown in FIG. 6, the control apparatus includes a first detecting module 10 and a first controlling module 20.

The first detecting module 10 is configured to detect and confirm that the refrigerator is in the first control period after defrosting. The first controlling module 20 is configured to detect and confirm that an ice making evaporator requests refrigeration, and control a control valve to connect to an ice making circuit.

Specifically, the first detecting module 10 can detect and confirm that whether the refrigerator is in the first control period after defrosting. If the first detecting module 10 detects and confirms that the refrigerator is in the first control period after defrosting, the first controlling module 20 detects that whether the ice making evaporator requests refrigeration, and if the ice making evaporator requests refrigeration, depending on whether the refrigerating evaporator requests refrigeration or not, the first controlling module 20 connects the control valve to the ice making capillary, such that the control valve is connected to the ice making circuit, and thus ensuring the refrigerant to be flow into the ice making circuit preferentially when the ice making evaporator requests refrigeration after defrosting, and ensuring the temperature of the ice making compartment return to a preset range rapidly, thereby effectively decreasing the time of the ice making compartment being in the high-temperature state caused by the defrosting, reducing the risk where ice tubes melt and the melted ice cubes are adhered together resulted from re-freezing of the melted ice cubes. As a result, a long-term and high-quality storage of the ice cubes.

According to some embodiments of the present disclosure, the first controlling module 20 is further configured to: detect and confirm that the ice making evaporator requests refrigeration and the system evaporator does not request refrigeration, and control the control valve to connect to the ice making circuit; detect and confirm that the ice making evaporator does not request refrigeration and the system evaporator requests refrigeration, and control the control valve to connect to the refrigerating circuit; or detect and confirm that the ice making evaporator does not request refrigeration and the system evaporator does not request refrigeration, and control the control valve to remain at the current direction.

According to an embodiment of the present disclosure, the above control apparatus of a refrigerator may further include a second detecting module and a second controlling module.

The second detecting module is configured to detect and confirm that the refrigerator is in a non-first control period after defrosting. The second controlling module is configured to:

detect and confirm that the ice making evaporator requests refrigeration and the system evaporator requests refrigeration; control the control valve to connect to the refrigerating circuit, when the ice making circuit is connected to the refrigerating circuit in series and parallel; control the control valve to connect to the refrigerating circuit and the ice making circuit respectively, when the ice making circuit is connected to the refrigerating circuit in parallel only; detect and confirm that the ice making evaporator requests refrigeration and the system evaporator does not request refrigeration, and control the control valve to connect to the ice making circuit; detect and confirm that the ice making evaporator does not request refrigeration and the system evaporator requests refrigeration, and control the control valve to connect to the refrigerating circuit; or detect and confirm that the ice making evaporator does not request refrigeration and the system evaporator does not request refrigeration, and control the control valve to remain at the current direction.

In summary, according to the control apparatus of a refrigerator in embodiments of the present disclosure, the first detecting module detects and confirms that the refrigerator is in the first control period after defrosting, and the first controlling module detects and confirms that the ice making evaporator requests refrigeration, and controls the control valve to connect to the ice making circuit, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

Further, the present disclosure in embodiments further provides a refrigerator including a control apparatus of a refrigerator as described above.

According to embodiments of the present disclosure, the refrigerator can control the refrigerant using the above control apparatus to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

The present disclosure in embodiments further provides an electronic device, including a memory, a processor, and a computer program stored in the memory and executable by the processor, wherein the processor, when executing the program, achieves the method for controlling a refrigerator as described above.

According to embodiments of the present disclosure, when the processor executes the computer program stored in the memory, and when a refrigerator is in the first control period after defrosting, the electronic device controls a control valve to connect to an ice making circuit, if an ice making evaporator requests refrigeration, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

The present disclosure provides in embodiments a non-temporary computer-readable storage medium having stored therein a computer program that, when executed by a processor, achieves the method for controlling a refrigerator in the present disclosure as described above.

According to embodiments in the present disclosure, when the processor executes the computer program stored in the non-temporary computer-readable storage medium, and when a refrigerator is in the first control period after defrosting, the non-temporary computer-readable storage medium controls a control valve to connect to an ice making circuit, if an ice making evaporator requests refrigeration, such that the refrigerant can be controlled to flow into the ice making circuit preferentially after defrosting for the refrigerator, thereby effectively decreasing the time of the ice making compartment being in the high-temperature state caused by the defrosting, reducing the risk where ice tubes melt and melted ice cubes are adhered together resulted from re-freezing of the melted ice cubes. As a result, a long-term and high-quality storage of the ice cubes can be achieved.

In the specification, it should be understood that, the terms indicating orientation or position relationship such as "central," "longitudinal," "lateral," "width," "thickness," "above," "below," "front," "rear," "right," "left," "vertical," "horizontal," "top," "bottom," "inner," "outer," "clockwise," "counter-clockwise," "axial," "radial," "circumferential" should be construed to refer to the orientation or position relationship as then described or as shown in the drawings. These terms are merely for convenience and concision of description and do not alone indicate or imply that the device or element referred to must have a particular orientation or must be configured or operated in a particular orientation. Thus, it cannot be understood to limit the present disclosure.

In addition, terms such as "first" and "second" are used herein for purposes of description and are not intended to indicate or imply relative importance or significance or impliedly indicate quantity of the technical feature referred to. Thus, the feature defined with "first" and "second" may comprise one or more this features. In the description of the present disclosure, "a plurality of" means two or more than two this features, unless specified otherwise.

In the present disclosure, unless specified or limited otherwise, the terms "mounted," "connected," "coupled," "fixed" and the like are used broadly, and may be, for example, fixed connections, detachable connections, or integrated connections; may also be mechanical or electrical connections; may also be direct connections or indirect connections via intervening structures; may also be inner communications of two elements or mutual interaction between two elements, unless specified otherwise, which can be understood by those skilled in the art according to specific situations.

In the present disclosure, unless specified or limited otherwise, a structure in which a first feature is "on" or "below" a second feature may be an embodiment in which the first feature is in direct contact with the second feature, or an embodiment in which the first feature and the second feature are contacted indirectly via an intermediation. Furthermore, a first feature "on," "above" or "on top of" a second feature may include an embodiment in which the first feature is right or obliquely "on," "above" or "on top of" the second feature, or just means that the first feature is at a height higher than that of the second feature; while a first feature "below," "under" or "on bottom of" a second feature may include an embodiment in which the first feature is right or obliquely "below," "under" or "on bottom of" the second feature, or just means that the first feature is at a height lower than that of the second feature.

Reference throughout this specification to "an embodiment," "some embodiments," "an example," "a specific example" or "some examples" means that a particular feature, structure, material, or characteristic described in connection with the embodiment or example is included in at least one embodiment or example of the present disclosure. Thus, the appearances of the phrases such as "in some embodiments," "in one embodiment," "in an embodiment," "in another example," "in an example," "in a specific example" or "in some examples," in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art can combine different embodiments or examples and features in different embodiments or examples without contradicting each other.

Although explanatory embodiments have been shown and described, it would be appreciated by those skilled in the art that the above embodiments cannot be construed to limit the present disclosure, and changes, alternatives, and modifications can be made in the embodiments in the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claim is:

1. A method for controlling a refrigerator, comprising:

determining whether the refrigerator is in a target control period after defrosting;

determining whether an ice making evaporator requests refrigerant;

determining whether a system evaporator requests refrigerant; and in response to determining that the refrigerator is in the target control period after defrosting:

controlling a control valve to flow refrigerant to an ice making circuit coupled to the ice making evaporator no matter whether the system evaporator requests refrigerant or not;

in response to determining that the refrigerator is not in the target control period after defrosting, and:

(a) in response to determining that the ice making evaporator requests refrigerant and the system evaporator requests refrigerant, controlling the control valve to flow refrigerant to a refrigerating circuit coupled to the system evaporator and to the ice making circuit coupled to the ice making evaporator;

(b) in response to determining that the ice making evaporator requests refrigerant and the system evaporator does not request refrigerant, controlling the control valve to connect to the ice making circuit;

(c) in response to determining that the ice making evaporator does not request refrigerant and the system evaporator requests refrigerant, controlling the control valve to connect to the refrigerating circuit; and (d) in response to determining that the ice making evaporator does not request refrigerant and the system evaporator does not request refrigerant, controlling the control valve to keep a current direction unchanged.

2. The method of claim 1, further comprising in response to determining the refrigerator is in the target control period after defrosting, the ice making evaporator not requesting refrigerant, and the system evaporator requesting refrigerant, controlling the control valve to connect to the refrigerating circuit.

3. The method of claim 1, further comprising in response to determining the refrigerator is in the target control period after defrosting, the ice making evaporator not requesting refrigerant, and the system evaporator not requesting refrigerant, controlling the control valve to remain at a current direction.

4. The method of claim 1, wherein the ice making circuit is connected to the refrigerating circuit in series and parallel, and the controlling the control valve to flow refrigerant to the refrigerating circuit coupled to the system evaporator and to the ice making circuit coupled to the ice making evaporator includes controlling the control valve to connect to the refrigerating circuit only.

5. The method of claim 1, wherein the ice making circuit is connected to the refrigerating circuit in parallel only, and the controlling the control valve to flow refrigerant to the refrigerating circuit coupled to the system evaporator and to the ice making circuit coupled to the ice making evaporator includes controlling the control valve to connect to the refrigerating circuit and the ice making circuit respectively.

6. A refrigerator, comprising:

an ice making evaporator;

an ice making circuit coupled to the ice making evaporator;

a system evaporator;

a refrigerating circuit coupled to the system evaporator, a processor; and a storage device having executable instructions stored thereon, which when executed by the processor, enable the processor to implement acts including:

determining whether the refrigerator is in a target control period after defrosting;

determining whether the ice making evaporator requests refrigerant;

determining whether the system evaporator requests refrigerant; and in response to determining that the refrigerator is in the target control period after defrosting:

controlling a control valve to flow refrigerant to the ice making circuit no matter whether the system evaporator requests refrigerant or not;

in response to determining that the refrigerator is not in the target control period after defrosting, and:

(a) in response to determining that the ice making evaporator requests refrigerant and the system evaporator requests refrigerant, controlling the control valve to flow refrigerant to the refrigerating circuit and to the ice making circuit;

(b) in response to determining that the ice making evaporator requests refrigerant and the system evaporator does not request refrigerant, controlling the control valve to connect to the ice making circuit;

(c) in response to determining that the ice making evaporator does not request refrigerant and the system evaporator requests refrigerant, controlling the control valve to connect to the refrigerating circuit; and (d) in response to determining that the ice making evaporator does not request refrigerant and the system evaporator does not request refrigerant, controlling the control valve to keep a current direction unchanged.

7. The refrigerator of claim 6, wherein the acts further include in response to determining the refrigerator is in the target control period after defrosting, the ice making evaporator not requesting refrigerant, and the system evaporator requesting refrigerant, controlling the control valve to connect to the refrigerating circuit.

8. The refrigerator of claim 6, wherein the acts further include in response to determining the refrigerator is in the target control period after defrosting, the ice making evaporator not requesting refrigerant, and the system evaporator not requesting refrigerant, controlling the control valve to remain at a current direction.

9. The refrigerator of claim 6, wherein the ice making circuit is connected to the refrigerating circuit in series and parallel, and the controlling the control valve to flow refrigerant to the refrigerating circuit coupled to the system evaporator and to the ice making circuit coupled to the ice making evaporator includes controlling the control valve to connect to the refrigerating circuit only.

10. The refrigerator of claim 6, wherein the ice making circuit is connected to the refrigerating circuit in parallel only, and the controlling the control valve to flow refrigerant to the refrigerating circuit coupled to the system evaporator and to the ice making circuit coupled to the ice making evaporator includes controlling the control valve to connect to the refrigerating circuit and the ice making circuit respectively.

11. A non-transitory storage medium having executable instructions stored thereon, which when executed by a processor, enable the processor to implement acts to control operation of a refrigerator, wherein the refrigerator includes an ice making evaporator, an ice making circuit coupled to the ice making evaporator, a system evaporator, and a refrigerating circuit coupled to the system evaporator, and the acts comprising:

determining whether the refrigerator is in a target control period after defrosting;

determining whether the ice making evaporator requests refrigerant;

determining whether the system evaporator requests refrigerant; and in response to determining that the refrigerator is in the target control period after defrosting, and:

controlling a control valve to flow refrigerant to the ice making circuit no matter whether the system evaporator requests refrigerant or not;

in response to determining that the refrigerator is not in the target control period after defrosting:

(a) in response to determining that the ice making evaporator requests refrigerant and the system evaporator requests refrigerant, controlling the control valve to flow refrigerant to the refrigerating circuit and to the ice making circuit;

(b) in response to determining that the ice making evaporator requests refrigerant and the system evaporator does not request refrigerant, controlling the control valve to connect to the ice making circuit;

(c) in response to determining that the ice making evaporator does not request refrigerant and the system evaporator requests refrigerant, controlling the control valve to connect to the refrigerating circuit; and (d) in response to determining that the ice making evaporator does not request refrigerant and the system evaporator does not request refrigerant, controlling the control valve to keep a current direction unchanged.

12. The non-transitory storage medium of claim 11, wherein the acts further comprise in response to determining the refrigerator is in the target control period after defrosting, the ice making evaporator not requesting refrigerant, and the system evaporator requesting refrigerant, controlling the control valve to connect to the refrigerating circuit.

13. The non-transitory storage medium of claim 11, wherein the acts further comprise in response to determining the refrigerator is in the target control period after defrosting, the ice making evaporator not requesting refrigerant, and the system evaporator not requesting refrigerant, controlling the control valve to remain at a current direction.

14. The non-transitory storage medium of claim 11, wherein the ice making circuit is connected to the refrigerating circuit in series and parallel, and the controlling the control valve to flow refrigerant to the refrigerating circuit coupled to the system evaporator and to the ice making circuit coupled to the ice making evaporator includes controlling the control valve to connect to the refrigerating circuit only.

15. The non-transitory storage medium of claim 11, wherein the ice making circuit is connected to the refrigerating circuit in parallel only, and the controlling the control valve to flow refrigerant to the refrigerating circuit coupled to the system evaporator and to the ice making circuit coupled to the ice making evaporator includes controlling the control valve to connect to the refrigerating circuit and the ice making circuit respectively.

* * * * *